US006003334A

United States Patent [19]

Miller

[11] Patent Number: 6,003,334

[45] Date of Patent: Dec. 21, 1999

[54] FINGER RING SIZE ADJUSTING DEVICE AND METHOD

[76] Inventor: Bryan J. Miller, 75 N. Ridgewood Ave., Ormond Beach, Fla. 32174

[21] Appl. No.: 08/871,413

[22] Filed: Jun. 9, 1997

Related U.S. Application Data

[63] Continuation-in-part of application No. 08/282,954, Jul. 29, 1994, Pat. No. 5,636,531.

[51] Int. Cl.[6] ..... A44C 9/02

[52] U.S. Cl. ..... 63/15.5; 63/15.6; 63/15.65

[58] Field of Search ..... 63/15.45, 15.5, 63/15.6, 15.65

[56] References Cited

U.S. PATENT DOCUMENTS

| | | | |
|---|---|---|---|
| 274,193 | 3/1883 | Henrich . | |
| 1,075,673 | 10/1913 | Segman . | |
| 2,615,314 | 10/1952 | Axel | 63/15.6 |
| 2,745,265 | 5/1956 | Grafstein | 63/15.6 |
| 2,745,266 | 5/1956 | Grafstein | 63/15.6 |
| 3,150,505 | 9/1964 | Olson . | |
| 3,214,939 | 11/1965 | Monahan | 63/15.6 |
| 3,237,426 | 3/1966 | Doering | 63/15.6 |
| 3,360,959 | 1/1968 | Schechter et al. . | |
| 3,465,544 | 9/1969 | Tucker . | |
| 3,483,718 | 12/1969 | Lodrini | 63/15.6 |
| 3,590,598 | 7/1971 | Leone . | |
| 3,603,109 | 9/1971 | Virtanen | 63/15.6 |
| 3,901,045 | 8/1975 | Ballester | 63/15.65 |
| 4,215,556 | 8/1980 | Mroz . | |
| 4,223,541 | 9/1980 | Martinez | 63/15.6 |
| 4,471,634 | 9/1984 | Kaplan | 63/15.6 |
| 4,480,447 | 11/1984 | Lodrini | 63/15.6 |
| 4,526,016 | 7/1985 | Cercone . | |
| 5,253,491 | 10/1993 | Buontempo et al. . | |
| 5,636,531 | 6/1997 | Miller | 63/15.6 |

FOREIGN PATENT DOCUMENTS

| | | |
|---|---|---|
| 1191407 | 4/1959 | France . |

*Primary Examiner*—Terry Lee Melius
*Assistant Examiner*—Andrea Chop
*Attorney, Agent, or Firm*—Allen, Dyer, Doppelt, Milbrath & Gilchrist, P.A.

[57] ABSTRACT

A finger ring size adjustment device comprises a ring shank and a cradle which is biased radially inward from the shank. The cradle is moveable between a retracted position and an adjusted position for reducing the ring size. The ring wearer thus has an adjustable ring shank for easily sliding over an enlarged knuckle or joint and then to a desired fit on the phalanx portion of the finger. The cradle is biased inwardly toward the adjusted position by a leaf spring in an automatically adjustable embodiment and a lever arm in an alternate embodiment. The manually operable lever arm is slidably engaged with the cradle and rotatably connected to the shank for moving the cradle between the retracted and adjusted positions. The lever arm is stored within the body of the shank when holding the cradle in the adjusted position. The leaf spring is carried by the shank and is positioned for biasing the cradle radially inward from the shank to the adjusted position which position is automatically set by the finger of the user. A feature of the invention includes the biasing member and cradle positioned within the boundaries of the shank for permitting the adjustable ring device to be used in juxtaposition with a second or companion ring and for avoiding the snagging of clothing by the adjustable ring.

14 Claims, 9 Drawing Sheets

FINGER RING SIZE ADJUSTING DEVICE AND METHOD

CROSS REFERENCE TO RELATED APPLICATION

This application is a Continuation-In-Part application of copending application Ser. No. 282,954 filed Jul. 29, 1994 and issuing as U.S. Pat. No. 5,636,531, commonly owned with the present invention.

BACKGROUND OF THE INVENTION

1. Field of the Invention

The present invention relates generally to a finger ring size opening adjustment device for enhancing the retention of a finger ring upon the wearer's finger and, more particularly to an adjustment device adapted to the ring shank for permitting passage of the ring over an enlarged knuckle for fitting a digital portion of the finger.

2. Description of Background Art

A well known problem in the fitting of finger rings is a condition where a wearer will have relatively large knuckles compared to the digital portion of his finger. If a ring is sized large enough to fit over the knuckle, it is typically too loose when it is past the knuckle and as a result is not properly secured to the digital portion of the finger resulting in an objectionable loose fit. A variety of devices have been developed that include adjustable shanks and devices for filling space between the inner surface of the shank and the digital portion of the finger.

By way of example, U.S. Pat. No. 1,075,673 to Segman discloses a finger ring adjustable to different size fingers after the ring has been placed on the finger. A screw threaded shank is disclosed which is secured to and carried within a setting and adapted to be received in a tapped opening in the ring. An adjustable plate is rotatably secured to an inner end of the screw threaded shank. A thumb screw used for adjusting the screw threaded shank is dimensioned to fit outside the shank within the head of the ring or in an alternative for extending outside the shank at a lower portion of the ring shank.

U.S. Pat. No. 3,150,505 to Olson discloses a finger ring having an adjustable ring guard wherein the ring setting at the upper end of the ring is provided with a centrally located recess beneath the setting. This recessed portion is dimensioned to accommodate an eccentric wheel. The wheel is mounted on a journal which is rotatably received within a blind bore and which extends transversely from one outer side of the ring through the recess. The journal at its outer portion is provided with a slotted end for rotation using a tool such as a screw driver and consequently the rotation of the eccentric wheel by means of a small screwdriver. Upon rotation of the wheel, a plunger extending upwardly into the recess causes a downward movement of a thin resilient metallic strip. The flexible strip is semi-circular in configuration and is provided at each end with two outwardly extending tabs which engage shank sides of the ring.

U.S. Pat. No. 3,483,718 to Lodrini discloses a device for narrowing the diameter of a finger ring which includes a short saddle-like insert fitted into the ring finger opening for constricting the opening size. The saddle comprises a moveable arcuate sector that fits around the bottom portion of the ring over shank side walls with spring therebetween.

By way of further example, known adjustment devices include crescent shaped elements hinged to a bottom portion of the shank for pivoting from a first position outside of the ring opening to a second position within the ring opening thus providing the adjustment such as disclosed in U.S. Pat. Nos. 3,465,544 to Tucker and 4,215,556 to Mroz. U.S. Pat. No. 3,590,598 to Leone discloses a finger ring with pivotally mounted size adjusting member actuated to reduce the internal ring size after the ring is on the finger so that a maximum ring opening can be provided for placing the ring on the finger. The pivoted element is adapted to be swung to a position in the plane of the ring, thereby decreasing the ring size and to a position at right angles to the plane of the ring, thereby opening the ring to its full original inside diameter.

Even with the innovative ring adjustment devices known in the art, there remains a need for adjusting a ring size that is simply done by the ring user without the need for tools and includes its adjusting elements such that the adjustable ring can be attractively used with a companion ring.

SUMMARY OF INVENTION

In view of the foregoing background, it is therefore an object of the present invention to provide a device and associated method for a person wearing a ring to adjust the size of the ring without the need for tools. It is yet another object to provide an adjustable ring shank that can be worn with a companion ring. It is further an object of the invention to provide a simple and inexpensive adjustable ring shank for use with both costume and gold jewelry. It is yet another object to provide an adjustable ring shank which will accommodate a variety of heads.

These and other objects, advantages and features of the present invention are provided by a finger ring size adjustment device which comprises a shank, cradle and cradle biasing means carried by the shank for biasing the cradle against a finger received within an opening of the ring shank. The shank includes an opening for receiving a finger therethrough, which shank is defined by a generally cylindrical shank periphery and side walls extending radially inward along the shank periphery. The cradle includes an arcuate central portion for receiving a finger portion. The cradle is operable within the shank periphery for movement between a retracted cradle position wherein the cradle is proximate the shank periphery for permitting the finger to freely pass through the opening of the shank to an adjusted cradle position wherein the cradle is displaced radially inward from the shank periphery for reducing the opening of the shank and receiving the finger within the opening having a reduced size fitting the finger. The entire cradle remains within the opening of the shank and shank periphery between and at the cradle positions. The cradle biasing means are carried by the shank for biasing the cradle against the finger when the finger is received within the shank opening. The cradle biasing means are positioned entirely within the opening of the shank and shank periphery when the cradle is in the adjusted cradle position.

In one embodiment of the present invention, the cradle biasing means comprise a leaf spring having end portions and a central portion therebetween, the end portions slidably attached to the shank, the central portion engagable with the cradle, the leaf spring biasing the cradle inward of the shank periphery to the adjusted cradle position, the leaf spring responsive to an apposing biasing by the finger as the finger is received within the opening, the finger biasing the cradle toward the retracted cradle position as the finger passes into the opening of the shank. In another embodiment of the present invention, the cradle biasing means comprise a lever arm having a central portion pivotally attached to the shank, the lever arm having an extensible arm portion extending from one side of the central portion, the extensible arm portion engagable with the cradle, the lever arm having a fulcrum arm portion extending from the central portion opposing the extensible arm portion, the fulcrum arm portion rotatable about the central portion of the lever arm for moving the extensible arm portion from a first lever arm position proximate the shank periphery wherein the cradle is in the retracted cradle position, to a second lever arm position extending the extensible arm portion inward of the shank periphery wherein the cradle is in the adjusted cradle position.

A method aspect of the invention includes the steps of biasing the cradle toward the shank periphery, passing the finger through the shank opening, positioning the shank at a preselected location along the finger, and then biasing the cradle against the finger for holding the finger at the preselected location along the finger.

BRIEF DESCRIPTION OF DRAWINGS

A preferred embodiment of the invention as well as alternate embodiments are described by way of example with reference to the accompanying drawings in which:

FIG. 25;

DETAILED DESCRIPTION OF PREFERRED EMBODIMENT

Figure 1:
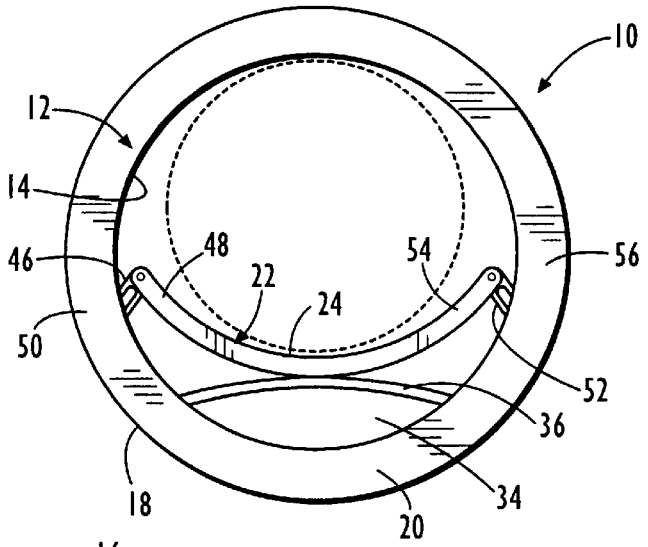
FIG. 1 is an elevational side view of a preferred embodiment of the present invention, an adjustable ring sizing device.
Figure 2:
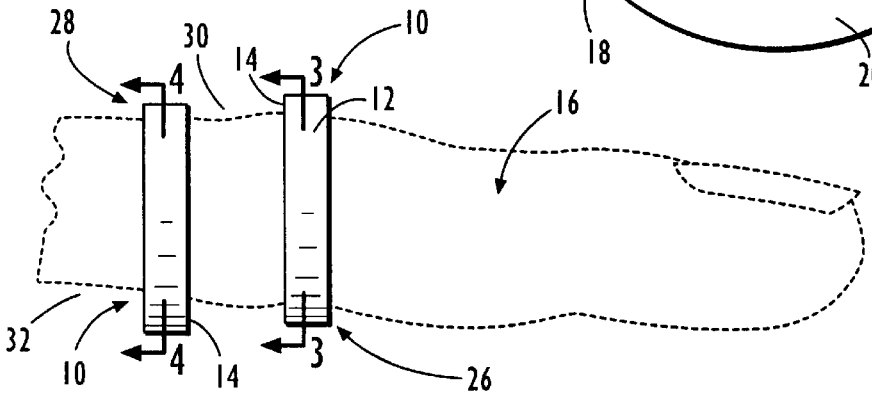
FIG. 2 is a partial view of a ring finger illustrating operation of the present invention passing over a knuckle of the finger to a closed position worn on a digital portion of the finger.
Figure 3:
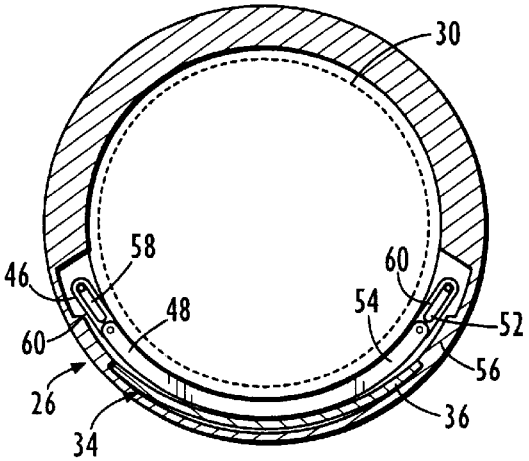
FIG. 3 is a cross-sectional view taken through lines 3—3 of FIG. 2.
Figure 4:
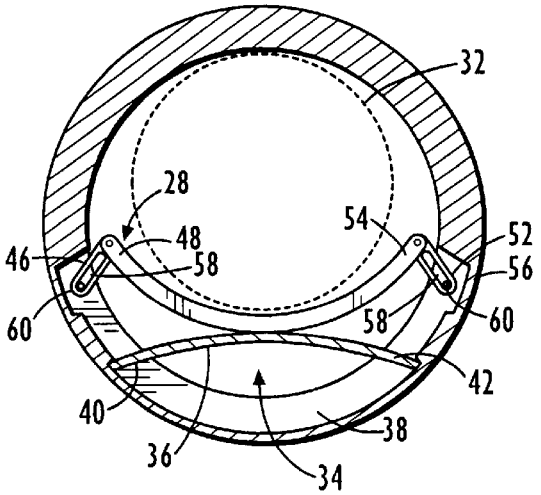
FIG. 4 is a cross-sectional view taken through lines 4—4 of FIG. 2.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now initially to FIGS. 1–4, one preferred embodiment of a finger ring size adjustment device 10 according to the invention comprises a shank 12 having an opening 14 for receiving a finger 16 therethrough. The shank 12 includes a generally cylindrical shank periphery 18 and side walls 20 extending radially inward along the shank periphery. As will be described later, the shank 12 can be affixed with a head for receiving a setting. A cradle 22 having an arcuate central portion 24 is carried within the shank periphery 18 for receiving the finger 16 thereon. The cradle 22 is operable while remaining within the shank periphery 18 for movement between a retracted cradle position 26 wherein the cradle 22 is proximate the shank periphery 18 for permitting the finger 16 to freely pass through the opening 14 of the shank 12, and movement to an adjusted cradle position 28 wherein the cradle is displaced radially inward from the shank periphery for reducing the size of the opening 14 of the shank 12 and receiving the finger within the opening having a reduced size for fitting the finger. By way of example, a finger ring having the device 10 permits a person having a large knuckle 30 to slide the ring onto the finger 16 past the large knuckle and onto a phalanx 32 of the finger which has a smaller girth than does the knuckle. Throughout operation of the device 10, the entire cradle 22 remains within the shank periphery 18, between and at the cradle positions 26, 28. As is understood, depending on the girth along portions of the finger 16, the retracted position 26 may be proximate the shank periphery 18 yet displaced therefrom.

As illustrated again with reference to FIGS. 1–4, cradle biasing means 34 includes a leaf spring 36 carried by the shank 12 for biasing the cradle 22 against the finger 16 when the finger is received within the shank opening 14. The cradle biasing means 34 are positioned entirely within the opening 14 and shank periphery 18 when the cradle 22 is in the adjusted cradle position 28. For the embodiment including the leaf spring 36, the leaf spring remains within the periphery 18 for all positions between the adjusted 28 and fully retracted 26. It is anticipated that a coil spring may be a biasing means of choice. Such an arrangement of the elements of the device 10 avoids snagging of clothing typical of ring appendages.

As illustrated again with reference to FIGS. 3 and 4, the shank 12 has a cavity 38 for receiving the cradle 22 when in the retracted position 26 fully retracted and against the shank periphery 18. Opposing end portions 40, 42 of the leaf spring 36 are slidably attached to the shank 12 within the cavity 36. A central portion 44 of the leaf spring 36 is engagable with the cradle 22, for biasing the cradle inward of the shank periphery 18 to the adjusted cradle position 28. The leaf spring 36 is responsive to an opposing biasing force by the finger 16 as the finger is received within the opening 14, the finger biasing the cradle to an appropriate retracted cradle position 26 as the knuckle 30 and phalanx 32 of the finger 16 pass into the opening 14 of the shank 12, as described earlier with reference to FIG. 2. Such biasing by the leaf spring 36 provides a desirable automatic or self-adjusting feature for sizing the shank opening 14 to the appropriate girth of the finger 16.

Figure 5:
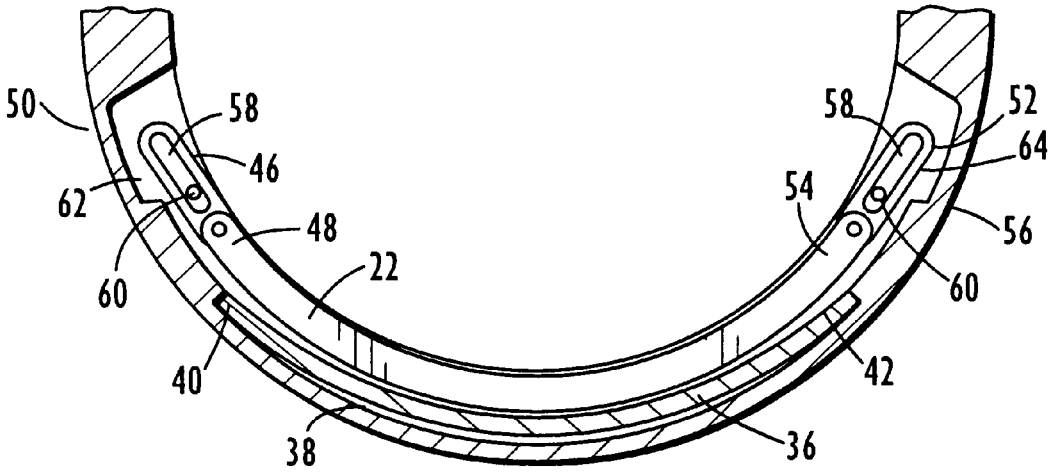
FIG. 5 and 6 are enlarged partial views of FIGS. 3 and 4 respectively.
Figure 6:
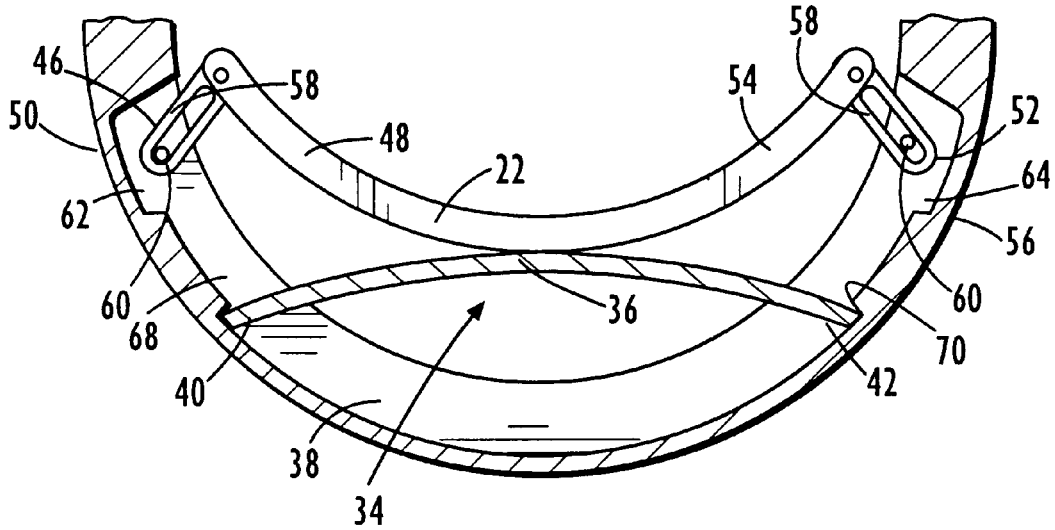
Figure 7:
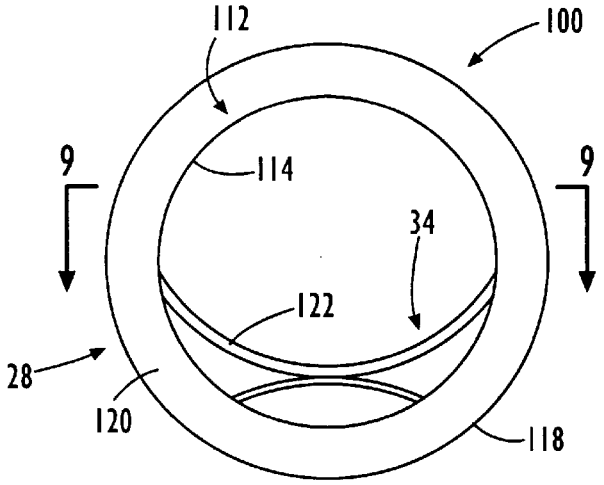
FIG. 7 is an elevational side view of an alternate embodiment of the present invention.
Figure 8:
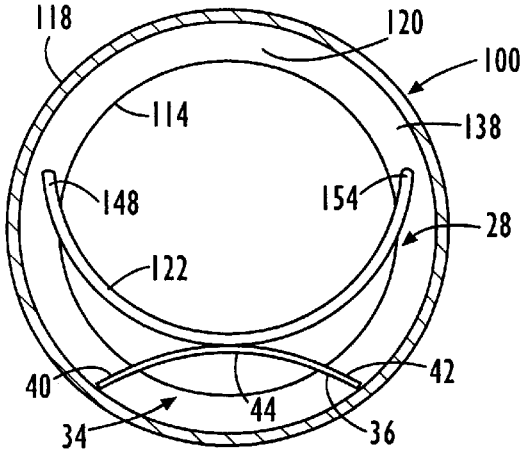
FIG. 8 is a cross-sectional view of the embodiment of FIG. 7 taken through lines 8—8 of FIG. 9.
Figure 9:
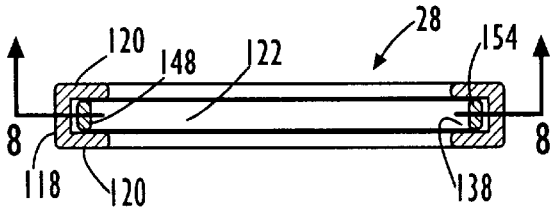
FIG. 9 is a cross-sectional view taken through lines 9—9 of FIG. 7.
Figure 10:
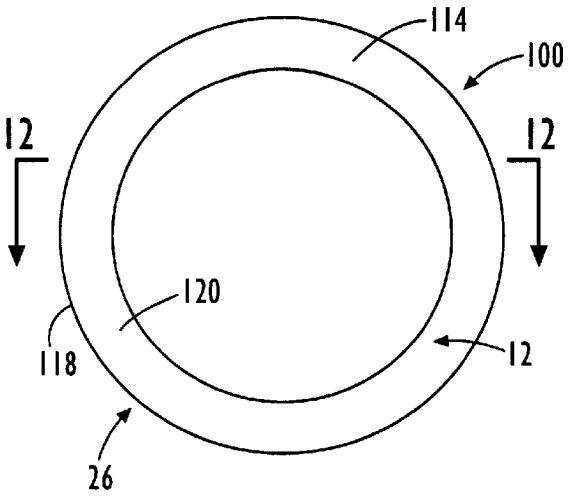
FIG. 10 illustrates the embodiment of FIG. 7 in a fully retracted cradle position.
Figure 11:
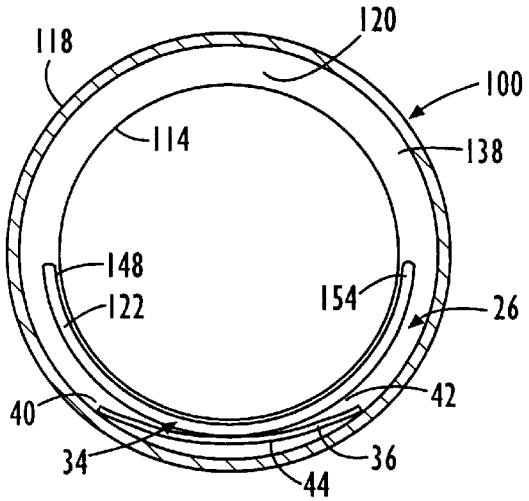
FIG. 11 is a cross-sectional view of FIG. 10 taken through lines 11—11 of FIG. 12.
Figure 12:
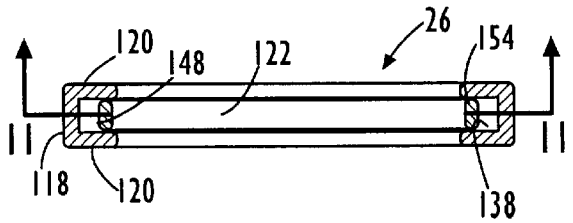
FIG. 12 is a cross-sectional view of FIG. 10 taken through lines 12—12 of FIG. 10.

Again with reference to FIGS. 1, 3 and 4, a first hinge 46 is pivotally attached between a first cradle end 48 and a first shank portion 50, and a second hinge 52 is pivotally attached between a second cradle end 54 and a second shank portion 56. The first and second hinges 46, 52 cooperate for movement of the cradle 22 between the retracted cradle position 26 and the adjusted cradle position 28. The cavity 38 of the shank 12, as illustrated again with reference to FIGS. 3 and 4, and in enlarged views of FIGS. 5 and 6, is formed for operation of the hinges 46, 52 therein. In an embodiment of the present invention, each hinge 46, 52 has a slot 58 for slidably receiving a hinge pin 60. Each shank first and second portions 50, 56 has a cavity portion 62, 64 therein for receiving the hinges 46, 52. Similarly, the cavity 38 includes a cavity portion 66 for slidably carrying the leaf spring 36. The opposing end portions 40, 42 of the leaf spring 36 slide within the cavity portion 66 between cavity wall stops 68, 70.

As illustrated now with reference to FIGS. 7–12, another embodiment of the present invention, a finger ring size adjustment device 100 according to the invention comprises a shank 112 having an opening 114 for receiving a finger 16 therethrough, discussed earlier with reference to FIG. 2. The shank 112 includes a generally cylindrical shank periphery 118 and side walls 120 extending radially inward along the shank periphery. A cradle 122 having an arcuate central portion 124 is carried within the shank periphery 118. The cradle 122 is operable while remaining within the shank periphery 118 for movement between the retracted cradle position 26 wherein the cradle 122 is proximate the shank periphery 118 for permitting the finger to freely pass through the opening 114 of the shank 112, and movement to the adjusted cradle position 28 wherein the cradle is displaced radially inward from the shank periphery for reducing the size of the opening 114 of the shank 112 and receiving the finger within the opening having a reduced size for fitting the finger. As described earlier, throughout operation of the devices 10, 100 the cradles 22, 122 remain within the shank periphery 18, 118 between and at the cradle positions 26, 28.

As earlier described, the cradle biasing means 34 includes the leaf spring 36 carried by the shank 112 for biasing the cradle 122 against the finger when the finger is received within the shank opening 114. The leaf spring 36 remains within the periphery 118 for all positions between the adjusted 28 and fully retracted 26.

Figure 13:
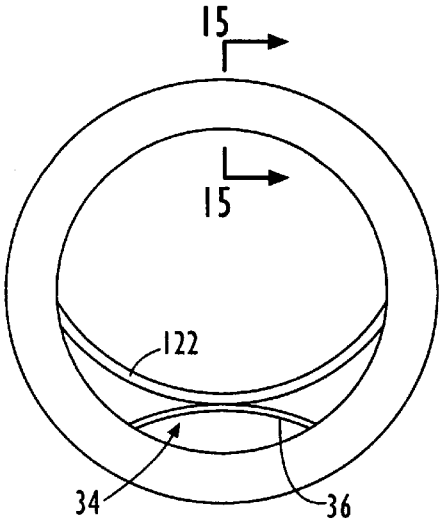
FIGS. 13 and 14 illustrate the embodiment of FIG. 7 having a tubular shank.
Figure 15:
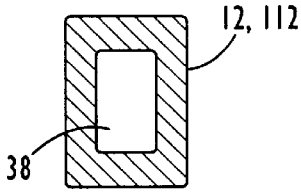
FIG. 15 is a cross-sectional view taken through lines 15—15 of FIG. 13.
Figure 14:
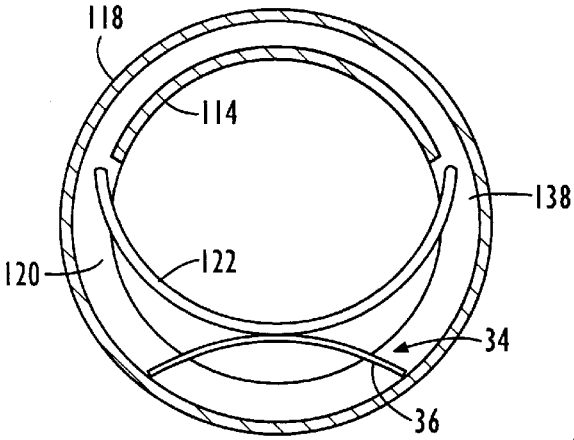

As illustrated again with reference to FIGS. 8, 9, 11 and 12, the shank 112 has a cavity 138 for receiving the cradle 122. The cradle 122 is slidably engaged within the cavity 138. In the embodiment illustrated with reference to FIGS. 7–12, the cavity 138 extends about the entire shank periphery 118 forming a channel for receiving the cradle 122 therein. As illustrated with reference to FIGS. 13–15, the shank 12, 112 can be constructed from a tubular material, wherein the cavity 38, 138 will be formed to accommodate the particular devices 10,100 described earlier and later to be described. As illustrated, by way of example with reference again to FIGS. 10–12, the cradle 122 can be positioned fully within the cavity 138 in a fully retracted position for the retracted cradle position 26. The cradle ends 148, 154 are slidable within the channel of the cavity 138 and are received within the channel between the adjusted and retracted positions 28, 26.

Figure 16:
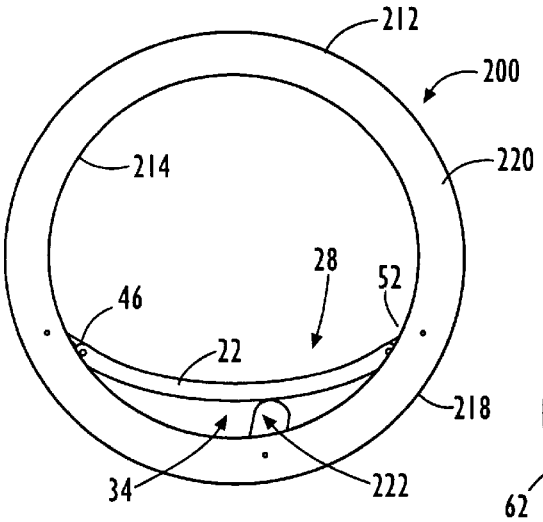
FIG. 16 is an elevational side view of another embodiment of the present invention.
Figure 17:
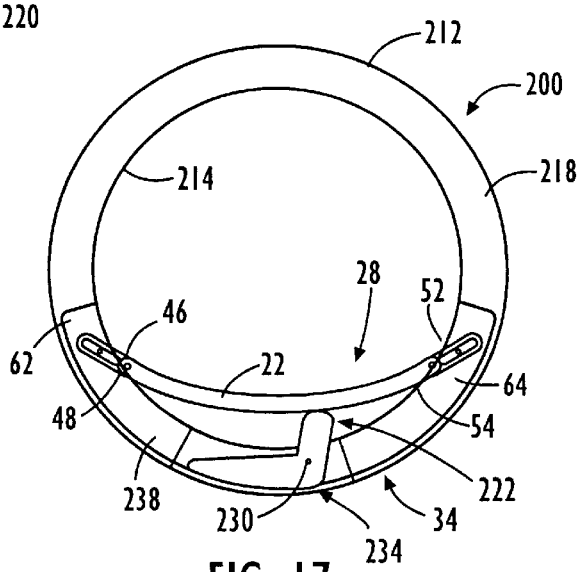
FIGS. 17 and 18 are cross-sectional views of the embodiment of FIG. 16 illustrating retracted and adjusted cradle positions respectively.
Figure 18:
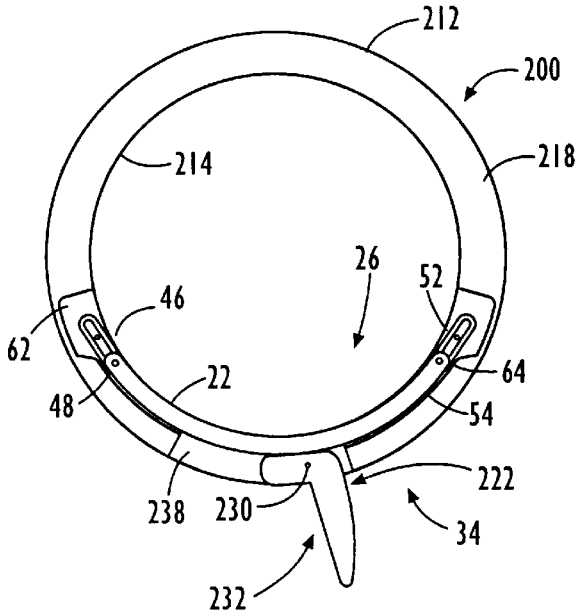

As illustrated now with reference to FIGS. 16–18, another embodiment of the present invention, a finger ring size adjustment device 200 according to the invention comprises a shank 212 having an opening 214 for receiving a finger 16 therethrough, discussed earlier with reference to FIG. 2. The shank 212 includes a generally cylindrical shank periphery 218 and side walls 220 extending radially inward along the shank periphery. Like that described earlier with reference to the device 10, the cradle 22 is carried within the shank periphery 218. The cradle 22 is operable while remaining within the shank periphery 218 for movement between the retracted cradle position 26 wherein the cradle 22 is proximate the shank periphery 218 for permitting the finger to freely pass through the opening 214 of the shank 212, and movement to an adjusted cradle position 28 wherein the cradle is displaced radially inward from the shank periphery for reducing the size of the opening 214 of the shank 212 and receiving the finger within the opening having a reduced size for fitting the finger. As described earlier, throughout operation of the device, the cradle 22 remains within the shank periphery between and at the cradle positions 26, 28. Hinges 46, 52 are operable with cradle ends 48, 54 within a cavity 238 of the shank 212 as described earlier with reference to FIGS. 1–6.

Figure 19:
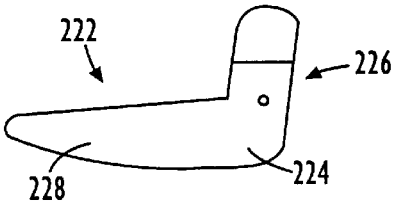
FIG. 19 is an elevational view of an alternate embodiment of a lever arm.
Figure 20:
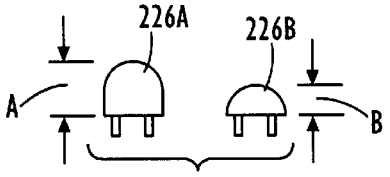
FIG. 20 illustrates lever arm extensive arm portions of varying length dimension for removable attachment to a central lever arm portion.
Figure 22:
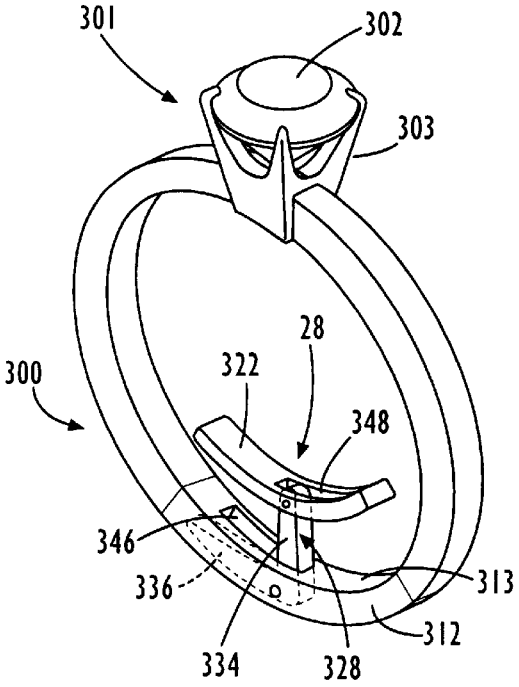
Figure 24:
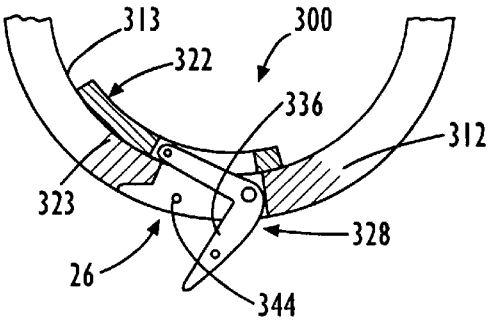
FIG. 24 is a partial cross-sectional side view of the embodiment of FIG. 22 illustrating a retracted cradle position.
Figure 25:
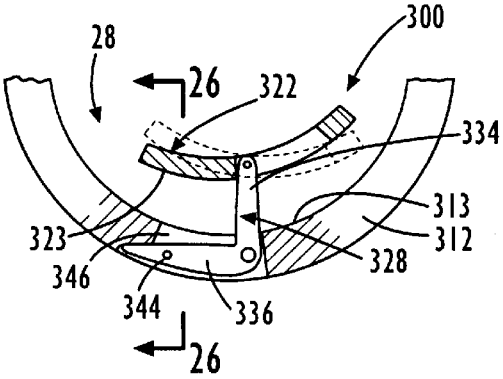
FIG. 25 is a partial cross-sectional side view of the embodiment of FIG. 22 illustrating an adjusted cradle position.
Figure 23:
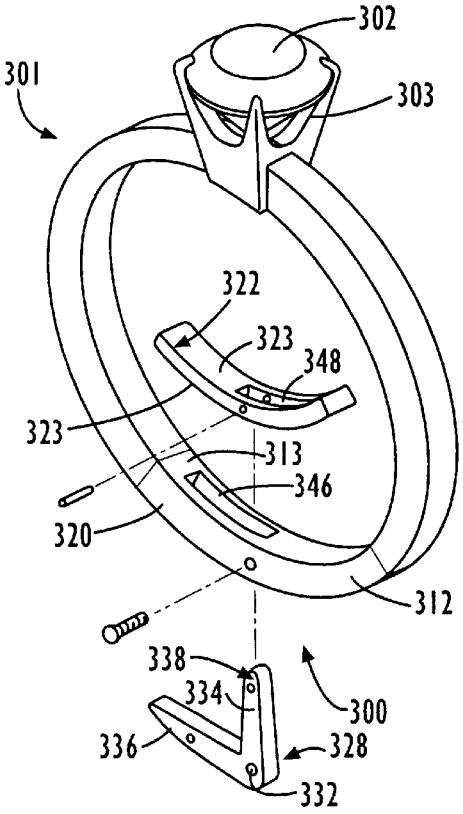
FIG. 23 is an exploded perspective view of the embodiment of FIG. 22.
Figure 26:
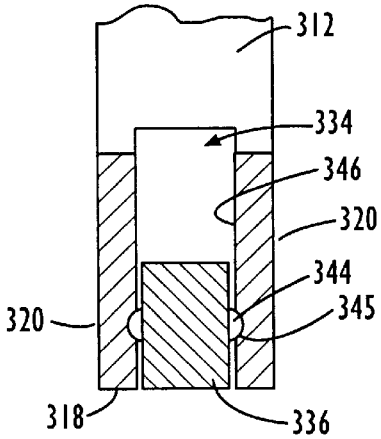
FIG. 26 is a partial cross-sectional view taken through line 26—26 of FIG.

The device 200 comprises the cradle biasing means 34 having a lever arm 222. The lever arm 222 has a central portion 224 pivotally attached to the shank 212. The lever arm 222 has an extensible arm portion 226 extending from one side of the central portion 224. The extensible arm portion 226 is engagable with the cradle 22. The lever arm 222 further includes a fulcrum arm portion 228 extending from the central portion 224 and opposing the extensible arm portion 226. The fulcrum arm portion 228 is rotatable about the central portion 224 via a pin 230 for moving the extensible arm portion from a first lever arm position 232 rotated outward of the shank periphery 218 wherein the cradle is in the retracted cradle position 26, to a second lever arm position 234 extending the extensible arm portion 226 inward of the shank periphery 218 wherein the cradle 22 is in the adjusted cradle position 28. As illustrated with reference to FIGS. 19 and 20, an alternate embodiment of the lever arm 222 includes the extensible arm portion 226 removably attached to the lever arm central portion 224 for providing extensible arm portions 226A, 226B of varying length dimensions (A,B) and thus varying biasing and opening for the adjusted cradle position 28.

Figure 21:
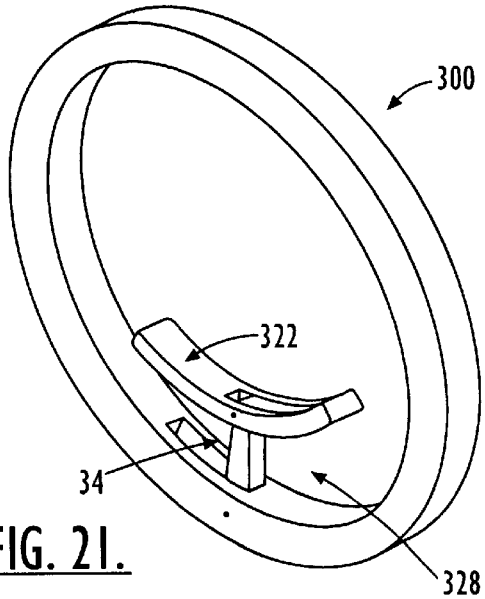
FIGS. 21 and 22 are perspective views of a shank and ring, respectively, illustrating an alternate embodiment of the present invention disclosed and incorporated herein by reference with copending parent application.

As illustrated again with reference to FIGS. 16–18, the lever arm 222 is slidably engagable with the cradle 22. As illustrated with reference to FIG. 21, yet another embodiment of the device 300 includes a cradle 322 pivotally connected to an extensible arm portion of a lever arm. Such an embodiment is disclosed in the reference parent application incorporated herein by way of reference. Portions of the parent application and issuing patent are included herein for convenience to the reader.

As illustrated with reference to FIGS. 22–26, a finger ring size opening adjustment device 300 is made a part of a ring 301. The ring 301 comprises a shank 312 having an inside diameter or opening 314 defined by a shank inner surface 315. The shank 312, by way of example, is further defined as having side wall surfaces 320 and an outer surface on the periphery 318. With specific reference to FIGS. 22 and 23, the ring 301 further comprises a setting 302 affixed within a head 303. The device 300 will typically be positioned within a shank portion opposing the ring head 303 as illustrated, by way of example, again with reference to FIG. 22. The cradle 322 has an outer surface 323 generally convex for mating with the shank inner surface 313 generally concave. The cradle 322 has an inside surface 325 to permit the finger to comfortably rest within the cradle 322.

As illustrated again with reference to FIG. 23, the device 300 includes a lever arm 328 having a generally L-shape wherein a central portion 330 forms the angle of the L. A pivot hole 332 is provided within the central portion 330. An extensible arm portion 334 forms one leg of the L while a fulcrum arm portion 336 forms the other. A lever arm second pivot hole 338 is provided for pivotally engaging the extensible arm portion 340 of the lever arm 328 with the cradle 322. As was described in the incorporated reference, the fulcrum arm portion 342 of the lever arm 328 has a detent 344 used to position the lever arm. Again with reference to FIGS. 22–26, the shank 312 has a cavity 346 defined by shank side wall portions 320. The cavity 346 is dimensioned to closely receive the lever arm 328 for permitting the lever arm 328 to pivot about its central portion 330. As detailed in the incorporated reference, pivot screw passes through threaded side wall holes and through the lever arm pivot hole in a journaled configuration for permitting rotation of the lever arm 328 about the pivot screw. The cradle 322 further comprises a cradle cavity 348 dimensioned to closely receive the extensible arm portion 334 of the lever arm 328. A pivot pin passes through pivot pin holes and through the second pivot hole of the extensible arm portion 334 for permitting rotation of the cradle 322 about an end of the extensible arm portion. With such an arrangement, it is appreciated that the cradle 322 can be moved from the retracted cradle position 26 as earlier described, wherein the cradle 322 mates with the shank inner surface 312 to the adjusted cradle position 28 wherein the cradle 322 extends radially inward of the shank 312 by a distance determined by the length of the extensible arm portion 334.

Yet again with reference to FIGS. 22–26, in the retracted cradle position 26, the extensible arm portion 334 rests within the cradle cavity 348 as the cradle outer surface 323 mates with the shank inner surface 313. In this position 26 the fulcrum arm portion 336 extends outward from the shank periphery 318. In the adjusted cradle position 28, the cradle 322 pivotally rotates about the extensible arm portion 334, while the fulcrum arm portion 336 resides within the shank cavity 346. The fulcrum arm portion 336 is closely received by the cavity 346 while the detent 344 is received by a notch 345 within the shank side wall as further illustrated again with reference to FIG. 26.

It is anticipated that the devices will be made with an original ring shank or inserted into a ring as an insert described in the incorporated reference. Regardless of the embodiments herein described, the invention as herein described, by way of example, with various embodiments, meets an objective for providing an adjustable ring that can be worn in juxtaposition with a ring guard or companion ring and worn without the concern for snagging clothing or other objects.

Figure 27:
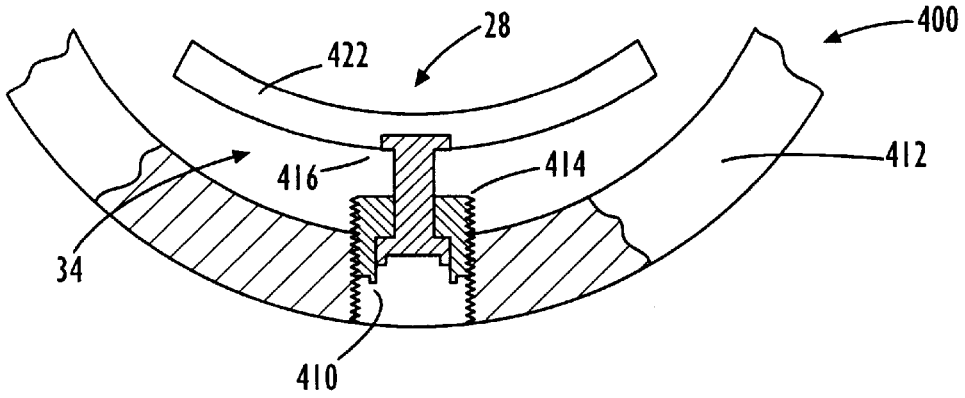
FIG. 27 is a partial cross-sectional view of an alternate embodiment of the present invention illustrating extensible concentric screw members.
Figure 28:
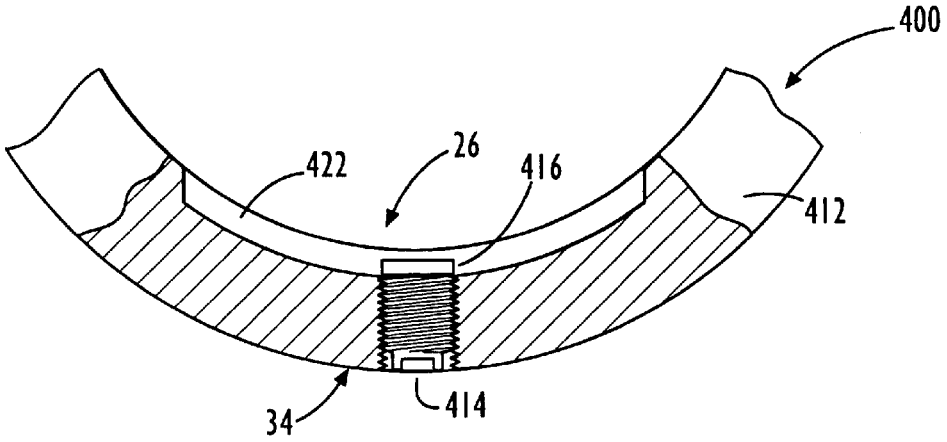
FIG. 28 is a partial cross-sectional view of the cradle recessed within the shank of an alternate embodiment of the invention illustrated in FIG. 27.
Figure 29:
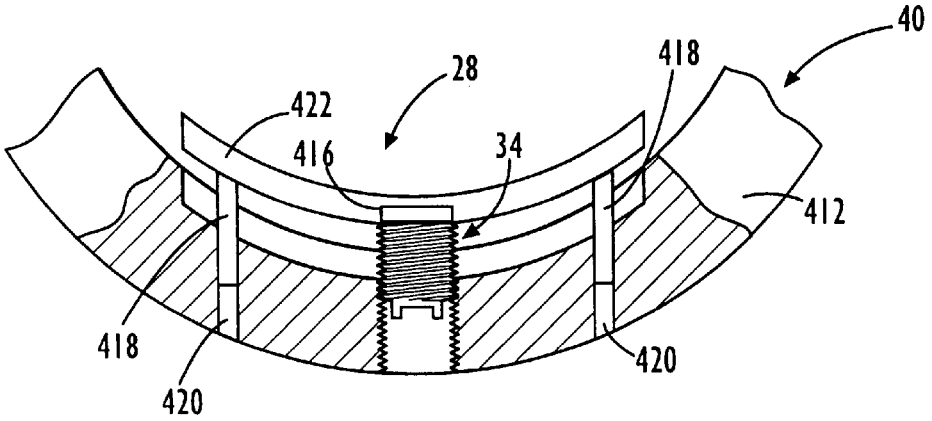
FIG. 29 is a partial cross-sectional side view of an alternate embodiment of the present invention using a single extensible screw and guide members.

With reference to FIGS. 27 and 28, and as incorporated by way of reference to the copending application, another embodiment includes a device 400 comprising a threaded bore 410 passing through the shank 412. The biasing means 34 in this embodiment comprise a single screw or telescoping concentric set screws 414 are dimensioned to be received by the threaded bore 410. By way of example, a central set screw communicates with an outer set screw and are dimensioned to lie within the shank 412 in the retracted cradle position 26 and extend radially into the shank opening to place the cradle 422 in the adjusted cradle position 28. The length of the set screws determines a preselected extensible distance. The cradle 422 engages a screw end 416. With reference to FIG. 29, guide posts 418 are affixed at one end to the cradle outer surface and extend into guide post holes 420 within the shank 412 dimensioned to closely receive the guide post. In the embodiment illustrated with reference to FIG. 29, two guide posts are placed symmetrically opposing each other on each side of the threaded bore.

Figure 30:
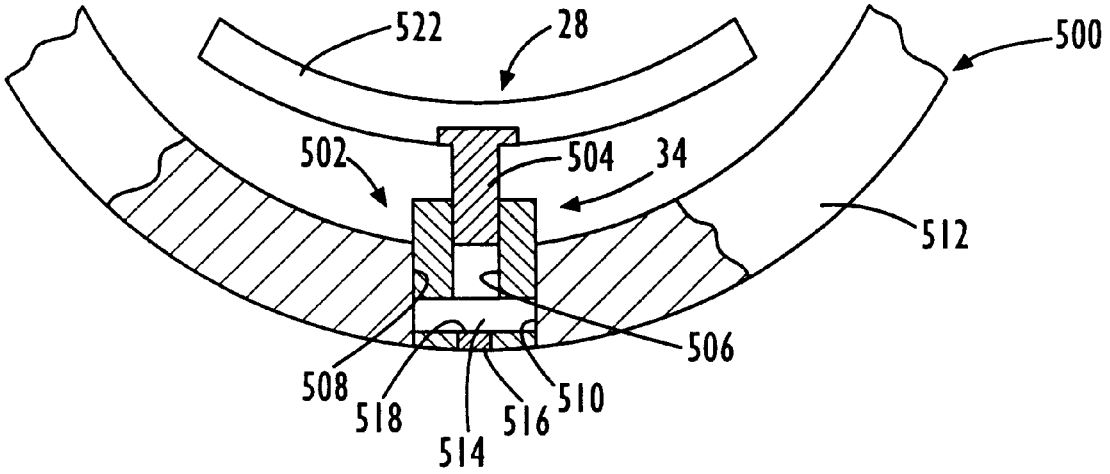
FIG. 30 is a partial cross-sectional side view of an alternate embodiment of the present invention illustrating the use of extensible piston members.
Figure 31:
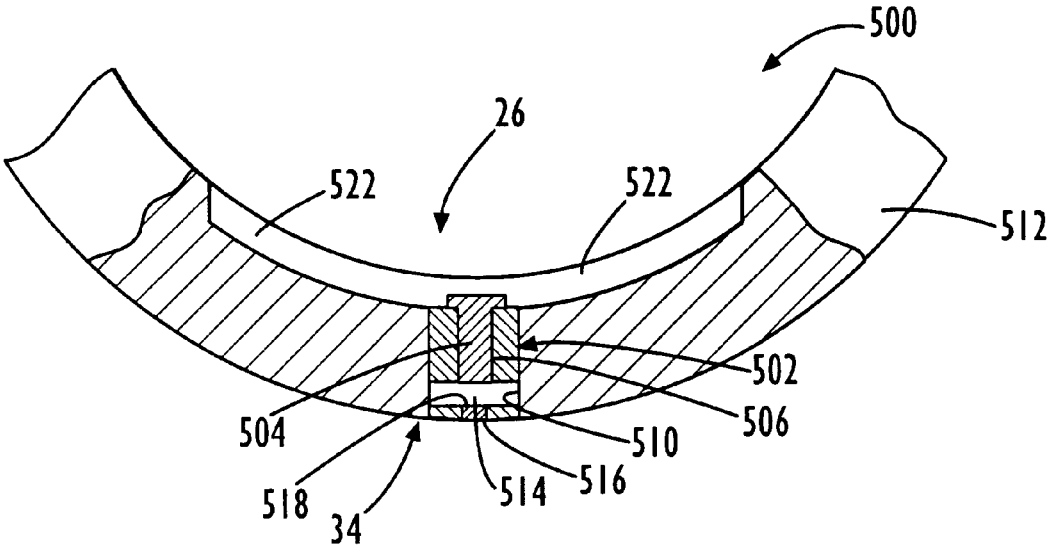
FIG. 31 is a partial cross-sectional view of the cradle recessed within the shank of an alternate embodiment of the invention of FIG. 30.

In yet another embodiment, the device 500 as illustrated with reference to FIGS. 30 and 31 comprises the biasing means 34 including a piston assembly 502 having a central piston 504 communicating with a bore 506 of an outer piston 508 wherein the outer piston is closely received by a bore 510 in the shank 512. Sealable means between the surface of the bore and the pistons form an air tight cavity 514 with a cap 516 sealably affixed to the shank outer surface for covering the bore 512. A valve 518 within the cap 516 provides access through the cap into the cavity 514 for injecting air therein for causing the piston assembly 502 to be extended thus biasing the cradle 522 against the finger and holding the cradle in the adjusted cradle position 28.

As illustrated by way of example with reference again to FIGS. 28 and 31, the cradle 522 in the retracted position 26 rests within a recess formed within the inner surface of the shank.

It is not unusual for the knuckle to require a ring size of 12 in order for the ring to receive the knuckle on its way to the phalanx portion which itself requires a size 5 ring. As described in related application and incorporated herein by way of reference, a ring sizer is often used to determine the appropriate ring size for the knuckle and the phalanx portion of the finger. Once the appropriate ring sizes have been determined the necessary ring size using the devices herein described can be adapted for providing a desired opening for both retracted cradle and extended positions.

While various embodiments of the invention have been described in detail herein above, it is to be understood that various modifications may be made from the specific details described herein without departing from the spirit and scope of the invention as set forth in the appended claims. Having now described the invention, the construction, the operation and use of preferred embodiments thereof, and the advantageous new and useful results obtained thereby, the new and useful constructions, methods of use and reasonable mechanical equivalents thereof obvious to those skilled in the art are set forth in the appended claims.

What is claimed is:

1. A finger ring size adjustment device comprising:

a shank having an opening for receiving a finger therethrough, the shank defined by a generally cylindrical shank periphery and side walls extending radially inward from the shank periphery, the shank further having a cavity therein and first and second portions;

a cradle having an arcuate central portion for receiving a finger portion, the cradle also having first and second ends, the cradle operable within the shank periphery for movement between a retracted cradle position wherein the cradle is proximate the shank periphery for permitting the finger to freely pass through the opening of the shank to an adjusted cradle position wherein the cradle is displaced radially inward from the shank periphery for reducing a size of the opening of the shank and receiving the finger within the opening having a reduced size fitting the finger;

first and second hinges, each hinge pivotally attaching the first and second cradle ends respectively, to the first and second shank portions respectively, the first and second shank portions each having a hinge pin carried within the cavity of the shank, each of the first and second hinges having a slot which pivotally and slidably receives one hinge pin respectively, the first and second hinges sliding along and pivoting around the hinge pins to move the cradle between the retracted cradle position and the adjusted cradle position; and cradle biasing means carried by the shank for biasing the cradle against the finger when the finger is received within the shank opening, the biasing means positioned within the cavity of the shank.

2. The finger ring size adjustment device according to claim 1, wherein the cavity is dimensioned for receiving the cradle therein.

3. The finger ring size adjustment device according to claim 1, wherein the shank further comprises a tubular shank.

4. A finger ring size adjustment device comprising:

a shank having an opening for receiving a finger therethrough, the shank defined by a generally cylindrical shank periphery and side walls extending radially inward from the shank periphery, the shank further having a cavity therein and first and second portions;

a cradle having an arcuate central portion for receiving a finger portion, the cradle also having first and second ends, the cradle operable within the shank periphery for movement between a retracted cradle position wherein the cradle is proximate the shank periphery for permitting the finger to freely pass through the opening of the shank to an adjusted cradle position wherein the cradle is displaced radially inward from the shank periphery for reducing a size of the opening of the shank and receiving the finger within the opening having a reduced size fitting the finger;

first and second hinges, each hinge pivotally attaching the first and second cradle ends respectively, to the first and second shank portions respectively, the first and second shank portions each having a hinge pin carried within the cavity of the shank, each of the first and second hinges having a slot which pivotally and slidably receives one hinge pin respectively, the first and second hinges sliding along and pivoting around the hinge pins to move the cradle between the retracted cradle position and the adjusted cradle position; and a spring carried by the shank for biasing the cradle against the finger when the finger is received within the shank opening.

5. The finger ring size adjustment device according to claim 4, wherein the spring comprises a leaf spring having end portions and a central portion therebetween, the end portions slidably attached to the shank, the central portion engagable with the cradle, the leaf spring biasing the cradle inward of the shank periphery to the adjusted cradle position, the leaf spring responsive to an opposing biasing by the finger as the finger is received within the opening, the finger biasing the cradle toward the retracted cradle position as the finger passes into the opening of the shank.

6. The finger ring size adjustment device according to claim 4 wherein the shank further comprises a tubular shank.

7. A method for sizing a ring to a finger, the method comprising the steps of:

providing a shank having an opening for receiving a finger therethrough, the shank defined by a generally cylindrical shank periphery and side walls extending radially inward from the shank periphery, the shank further having a cavity therein and first and second portions;

providing a cradle having an arcuate central portion for receiving a finger portion, the cradle also having first and second ends, the cradle operable within the shank periphery for movement between a retracted cradle position wherein the cradle is proximate the shank periphery for permitting the finger to freely pass through the opening of the shank to an adjusted cradle position wherein the cradle is displaced radially inward from the shank periphery for reducing a size of the opening of the shank and receiving the finger within the opening having a reduced size fitting the finger;

providing first and second hinges, pivotally attaching the first and second hinges respectively, between the first and second cradle ends respectively, and the first and second shank portions respectively, the first and second shank portions each having a hinge pin carried within the cavity of the shank, each of the first and second hinges having a slot which pivotally and slidably receives one hinge pin respectively, the first and second hinges sliding along and pivoting around the hinge pins to move the cradle between the retracted cradle position and the adjusted cradle position; and biasing the cradle toward the shank periphery by passing the finger through the shank opening;

positioning the shank at a preselected location along the finger; and biasing the cradle against the finger for holding the shank at the preselected location along the finger.

8. The ring sizing method according to claim 7, wherein the cradle biasing steps comprise the step of:

providing a leaf spring having end portions and a central portion therebetween;

slidably attaching the leaf spring end portions to the shank;

engaging the central portion of the leaf spring with the cradle, the leaf spring biasing the cradle inward of the shank periphery to the adjusted cradle position; and biasing the finger against the cradle to overcome an opposing biasing from the leaf spring for moving the cradle toward the shank periphery and permitting the finger to pass through the shank to the preselected location, the finger biasing the cradle toward the retracted cradle position as the finger passes into the opening of the shank, and wherein the opposing biasing by the leaf spring is sufficient for holding the shank at the preselected location.

9. The ring sizing method according to claim 7, further including the step of sliding the cradle within the cavity.

10. A finger ring size adjustment device comprising:

a shank having an opening for receiving a finger therethrough, the shank having a cavity therein, which cavity is accessible from the opening, the shank having first and second portions;

a cradle for receiving a finger, the cradle having first and second ends, the cradle operable for movement between a retracted cradle position wherein the cradle is within the cavity to an adjusted cradle position wherein the cradle is displaced radially inward from the shank for reducing a size of the opening of the shank;

first and second hinges, each hinge pivotally attaching the first and second cradle ends respectively, to the first and second shank portions respectively, the first and second shank portions each having a hinge pin carried within the cavity of the shank, each of the first and second hinges having a slot which pivotally and slidably receives one hinge pin respectively, the first and second hinges sliding along and pivoting around the hinge pins to move the cradle between the retracted cradle position and the adjusted cradle position; and cradle biasing means carried by the shank for biasing the cradle toward the adjusted cradle position, the biasing means responsive to an opposing biasing by the finger as the finger is received within the opening, the finger biasing the cradle toward the retracted cradle position as the finger passes into the opening of the shank.

11. The finger ring size adjustment device according to claim 10, wherein the biasing means comprises a spring.

12. The finger ring size adjustment device according to claim 11, wherein the spring comprises a leaf spring having end portions and a central portion therebetween, the end portions slidably carried within the cavity of the shank, the central portion slidable engaged with the cradle.

13. A method for sizing a shank opening of a ring to a finger having varying girth dimensions, the method comprising the steps of:

providing a shank having a shank periphery, a cavity, and an opening therein, the shank having first and second portions;

providing a cradle for receiving a finger, the cradle having first and second ends, providing first and second hinges, pivotally attaching the first and second hinges respectively, between the first and second cradle ends respectively, and the first and second shank portions respectively, the first and second shank portions each having a hinge pin carried within the cavity of the shank, each of the first and second hinges having a slot which pivotally and slidably receives one hinge pin respectively, the first and second hinges sliding along and pivoting around the hinge pins to move the cradle between the retracted cradle position and the adjusted cradle position;

operating the cradle within the opening for movement between a retracted cradle position wherein the cradle is proximate the shank periphery to an adjusted cradle position wherein the cradle is displaced radially inward from the shank periphery for reducing a size of the opening;

providing a spring for biasing the cradle toward the adjusted cradle position;

sliding the finger into the opening for biasing against the cradle to overcome spring biasing of the cradle toward the adjusted position, the biasing permitting movement of the cradle for permitting the finger to pass through the opening for placement at a desired location, the finger biasing the cradle toward the retracted cradle position as the finger passes through the opening, and wherein opposing biasing from the spring is sufficient for holding the shank at the desired location; and wearing the ring at the desired location.

14. The ring sizing method according to claim 13, wherein the spring comprises a leaf spring having ends of the leaf spring slidably carried within the cavity, a central portion of the leaf spring slidably engaging the cradle.

* * * * *